US005211318A

United States Patent [19]

Govatzidakis

[11] Patent Number: 5,211,318

[45] Date of Patent: May 18, 1993

[54] SELF-ADJUSTING LIQUID POURER

[76] Inventor: George J. Govatzidakis, Brown University, P.O. Box 1425, Providence, R.I. 02912

[21] Appl. No.: 801,402

[22] Filed: Dec. 2, 1991

[51] Int. Cl.[5] ..... B67D 3/00

[52] U.S. Cl. ..... 222/479; 222/500; 222/533; 222/567

[58] Field of Search ..... 222/477, 478, 479, 533, 222/568, 567, 500; 285/276

[56] References Cited

U.S. PATENT DOCUMENTS

| | | | |
|---|---|---|---|
| 1,756,094 | 4/1930 | McGuirk | 222/533 |
| 2,512,813 | 6/1950 | Sodders | 222/533 |
| 2,642,207 | 6/1953 | Renzi | 222/479 |
| 3,061,151 | 10/1962 | Clare | 222/478 |
| 3,104,786 | 9/1963 | Sanchis | 222/533 X |
| 3,139,224 | 6/1964 | Bloom | 222/478 |
| 3,517,952 | 6/1970 | McCracken | 285/276 |
| 4,296,952 | 10/1981 | McCracken | 285/276 X |

FOREIGN PATENT DOCUMENTS

| | | | |
|---|---|---|---|
| 568032 | 12/1958 | Canada | 222/533 |
| 821770 | 10/1959 | United Kingdom | 222/567 |

*Primary Examiner*—Andres Kashnikow
*Assistant Examiner*—Kenneth Bomberg
*Attorney, Agent, or Firm*—Richard L. Miller

[57] ABSTRACT

A self-adjusting liquid pourer is provided for a bottle having a neck, and consists of a casing, a mechanism for securing the casing to the neck of the bottle, a pouring spout assembly and another mechanism for rotatively securing the pouring spout assembly to the casing. The force of gravity will cause the pouring spout assembly to always rotate to a correct position with respect to the position of the bottle being held, so that the liquid can be poured our properly through the pouring spout assembly.

2 Claims, 1 Drawing Sheet

SELF-ADJUSTING LIQUID POURER

BACKGROUND OF THE INVENTION

The instant invention relates generally to pourer devices for fluid containers and more specifically it relates to a self-adjusting liquid pourer.

Numerous pourer devices for fluid containers have been provided in prior art that are adapted to help discharge fluids from the containers. For example, U.S. Pat. Nos. 3,434,636 to Kachman; 3,599,836 to Hegi; 4,010,875 to Babiol; 4,427,138 to Heinlein and Des. 285,892 to Doyel all are illustrative of such prior art. While these units may be suitable for the particular purpose to which they address, they would not be as suitable for the purpose of the present invention as heretofore described.

SUMMARY OF THE INVENTION

A primary object of the present invention is to provide a self-adjusting liquid pourer that will overcome the shortcomings of the prior art devices.

Another object is to provide a self-adjusting liquid pourer in which the liquid dispensing tube will always point in the desired position, that is downward, regardless of the orientation of the bottle.

An additional object is to provide a self-adjusting liquid pourer in which a smooth fast pouring is achieved, since the air hole is always on top and the liquid dispensing tube is always in position, so that there is no need to waste time by re-positioning the bottle.

A further object is to provide a self-adjusting pourer that is simple and easy to use.

A still further object is to provide a self-adjusting liquid pourer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
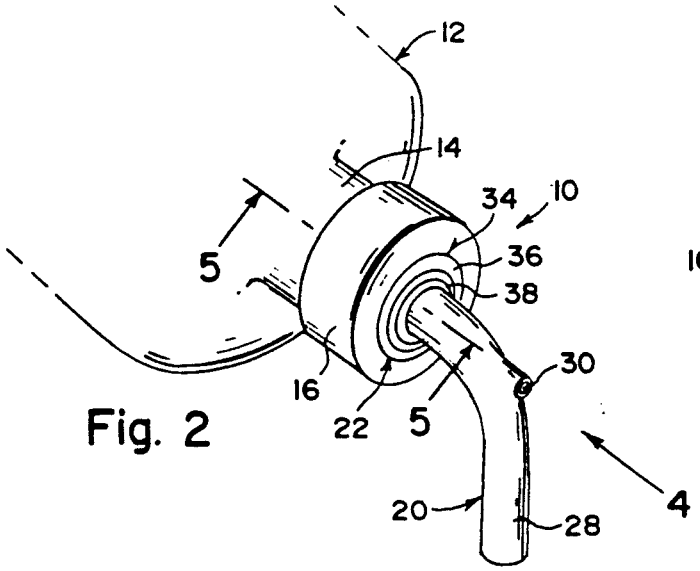
FIG. 2 is a perspective view of the instant invention installed into a neck of a bottle.
Figure 5:
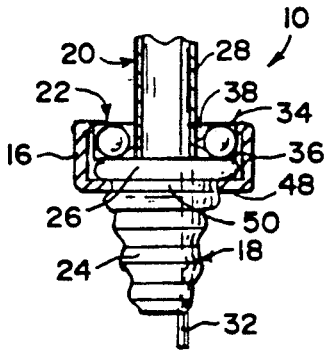
FIG. 5 is a cross sectional view with parts broken away taken along line 5—5 in FIG. 2 through the sealed ball bearing mechanism and the casing.

Turning now descriptively to the drawings, in which similar reference characters denote similar elements throughout the several views, FIGS. 2 through 5 illustrate a self-adjusting liquid pourer 10 for a bottle 12 having a neck 14. The pourer 10 consists of a casing 16 secured by an internal annular flange 48 to a mechanism

18 for securing the casing 16 to the neck 14 of the bottle 12, a pouring spout assembly 20 and another mechanism 22 for rotatively securing the pouring spout assembly 20 to the casing 16. Due to the forces of gravity acting on the spout assembly 20, the pouring spout assembly 20 will always be in a right position with respect to the position of the bottle 12 being held, so that the liquid can be poured hut properly through the pouring spout assembly 20.

The casing securing mechanism 18 includes a flexible tapered grooved hollow plug 24 affixed at one end 26 by an endmost groove 50 to the internal annular flange 48 of the rear portion of the casing 16 so that the plug 24 can be inserted within the neck 14 of the bottle 12.

The pouring spout assembly 20 includes a curved liquid dispensing tube 28 having an air vent 30 therein. The tube 28 extends outwardly from the rotating securing mechanism 22 and an elongated air tube 32 which extends rearwardly from the air vent 30 through the plug 24.

The rotating securing mechanism 22 is a sealed ball bearing mechanism 34 that includes an outer stationary cylindrical member 36 affixed to the casing 16 and an inner rotating cylindrical member 38 affixed to the curved liquid dispensing tube 28 of the pouring spout assembly 20.

Figure 1:
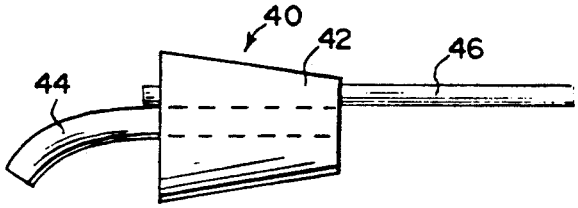
Fig. 1 PRIOR ART
FIG. 1 is a side view of the prior art.
Figure 3:
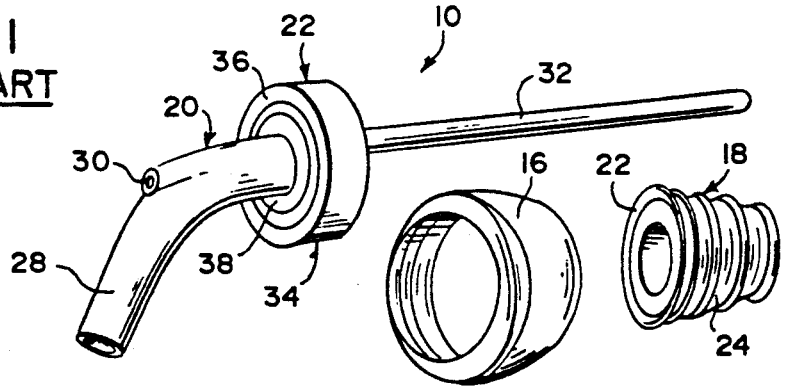
FIG. 3 is an exploded perspective view of the various components of the instant invention.
Figure 4:
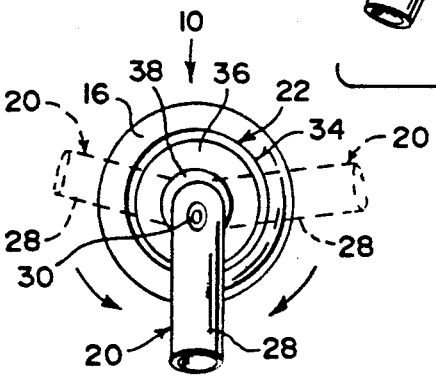
FIG. 4 is a front view taken in direction of arrow 4, in FIG. 2.

The prior art pourer device 40 is shown in FIG. 1, in which a cork 42 has a curved pouring tube 44 stationary affixed thereto. An air tube 46 also extends through the cork 42. If the pourer device 40 is placed upside down with respect to the bottle 12 it will not work properly.

To use the invention a person simply installs the self-adjusting liquid pourer 10 to the neck 14 of the bottle 12. When the person picks up the bottle 12 to pour out its contents the curved liquid dispensing tube 28 will be caused by the force of gravity to turn until its facing downwardly and the air vent 30 is on top.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self-adjusting liquid pourer for a bottle having a neck, which comprises:

a) a casing;

b) means for securing said casing to the neck of the bottle including a flexible, tapered, grooved hollow plug having one end affixed to a rear portion of said casing, so that the other end of said plug can be inserted with a force-fit within the neck of the bottle in liquid tight engagement therewith;

c) a pouring spout assembly comprising a curved liquid dispensing tube with inlet and outlet ends and having an external air vent therein, said inlet end being in communication with said hollow plug and an elongated air tube which extends from the air vent through said plug; and d) means for rotatively securing said pouring spout assembly to said casing comprising a sealed ball bearing mechanism including an outer stationary cylindrical race member affixed to said casing; and an inner rotating cylindrical race member affixed to an outside of said curved liquid dispensing tube of said pouring spout assembly adjacent the inlet end, whereby upon pouring gravitational force will cause said pouring spout assembly always to rotate to a position in which the outlet end is lowermost with respect to the position of the bottle, so that the liquid can be poured out through said pouring spout assembly.

2. A self-adjusting liquid pourer as recited in claim 1 wherein the rear portion of the casing is formed with an internal annular flange which seats in an endmost groove of the plug thereby affixing the casing to the plug.

* * * * *